US007037008B2

(12) United States Patent
Ota

(10) Patent No.: US 7,037,008 B2
(45) Date of Patent: May 2, 2006

(54) PRINTING APPARATUS, PRINTING CONTROL METHOD, AND PROGRAM FOR IMPLEMENTING THE METHOD

(75) Inventor: Takatoshi Ota, Kanagawa (JP)

(73) Assignee: Canon Kabushiki Kaisha, (JP)

( * ) Notice: Subject to any disclaimer, the term of this patent is extended or adjusted under 35 U.S.C. 154(b) by 163 days.

(21) Appl. No.: 10/883,544

(22) Filed: Jun. 30, 2004

(65) Prior Publication Data

US 2004/0265029 A1 Dec. 30, 2004

(30) Foreign Application Priority Data

Jun. 30, 2003 (JP) ..... 2003-188110
Apr. 28, 2004 (JP) ..... 2004-134547

(51) Int. Cl.
*B41J 11/44* (2006.01)

(52) U.S. Cl. ..... 400/76; 400/62; 400/55; 347/8

(58) Field of Classification Search ..... 400/55–59, 400/61, 62, 70, 76, 711; 347/5, 8, 19, 43
See application file for complete search history.

(56) References Cited

U.S. PATENT DOCUMENTS 5,257,867 A * 11/1993 Ito et al. ..... 400/56
5,499,876 A * 3/1996 Hosokawa et al. ..... 400/56
5,610,636 A * 3/1997 Hanabusa et al. ..... 347/8
6,629,787 B1 * 10/2003 Lee et al. ..... 400/59

FOREIGN PATENT DOCUMENTS

JP 8-118762 (A) 5/1996
JP 2001-162889(A) 6/2001

* cited by examiner

*Primary Examiner*—Minh Chau
(74) *Attorney, Agent, or Firm*—Rossi, Kimms & McDowell, LLP

(57) ABSTRACT

A printing apparatus which can eliminate the necessity of issuing a head-sheet gap setting command from a digital camera even during camera direct printing, and can positively prevent a recording medium from being rubbed by a recording head and becoming tainted. A head-sheet gap adjusting device carries out adjustment of the head-sheet gap between the recording head and the recording medium according to a command from an information processing apparatus. A CPU receives a temporary command effective for one printing and a setting command which stores a setting status of the printing apparatus. When the head-sheet gap is set by the setting command, the CPU causes the head-sheet gap adjusting device to carry out the adjustment according to the head-sheet gap set by the setting command, and performs printing, while ignoring the head-sheet gap designated by the temporary command.

11 Claims, 8 Drawing Sheets

*FIG. 7*

HEAD-SHEET GAP SETTING COMMAND

PaperGap=Wide

HEAD-SHEET GAP DESIGNATING JOB COMMAND

PaperGap=Auto

PRINTING APPARATUS, PRINTING CONTROL METHOD, AND PROGRAM FOR IMPLEMENTING THE METHOD

CROSS REFERENCE TO RELATED APPLICATION

This application claims priority from Japanese Patent Application No. 2003-118110 filed Jun. 30, 2003 and Japanese Patent Application No. 2004-134547 filed Apr. 28, 2004, which are hereby incorporated by reference.

BACKGROUND OF THE INVENTION

1. Field of the Invention

The present invention relates to a printing apparatus, a printing control method, and a program for implementing the method, and more particularly to a printing apparatus and a printing control method applied to an inkjet recording apparatus, which are capable of electrically and mechanically adjusting the gap between a recording head and a recording medium (hereinafter referred to as "the head-sheet gap") using a driving means such as a motor, as well as a program for implementing the printing control method.

2. Description of the Related Art

Conventionally, to adjust the head-sheet gap in an inkjet recording apparatus which prints (records) an image on a recording medium by discharging ink from a recording head to cause the ink to attach to the recording medium, there has been widely used a method in which the user adjusts the head-sheet gap by manually operating a head-sheet gap-adjusting lever, which is provided in the main body of the ink jet recording apparatus (refer to Japanese Laid-Open Patent Publication (Kokai) No. H08-118762, for example).

The reasons why the head-sheet gap is adjusted in the inkjet recording apparatus are as follows.

(1) If a variation in the head-sheet gap due to a difference in thickness of recording media is eliminated by adjustment, printing can be properly performed to obtain a stable image; and (2) Even if the head-sheet gap is properly set, a recording medium itself may ripple or warp during printing due to e.g. environmental changes. Then, the recording medium becomes tainted since the recording head rubs the recording medium, but this can be avoided by adjusting the head-sheet gap.

However, with functional improvement of the inkjet recording apparatus, it has become possible to provide the inkjet recording apparatus with a driving means such as a motor serving as a mechanism for adjusting the head-sheet gap so that the head-sheet gap can be electrically and mechanically adjusted via the driving means (refer to Japanese Laid-Open Patent Publication (Kokai) No. 2001-162889, for example).

Thus, in the conventional inkjet recording apparatus, it is possible to adjust the gap between the recording head and the recording medium, i.e. the head-sheet gap.

Further, in recent years, to reduce costs, there has been developed an inkjet recording apparatus which does not require a head-sheet gap-adjusting lever. In this inkjet recording apparatus, for example, the user electrically and mechanically adjusts the head-sheet gap via the above-mentioned driving means according to the type of a recording medium set through a user interface of a printer driver on a host computer connected to the inkjet recording apparatus.

FIG. 10 is a view showing an example of the user interface on a print setting screen of the printer driver.

As shown in FIG. 10, the user can set the type of sheet by selecting a desired setting value from a selection menu in FIG. 11 as an item in a selection field 1001 for designating the type of sheet as a recording medium. Then, according to the set type of the sheet, a suitable head-sheet gap is selected and output as a command in a print job. Therefore, it is possible to set suitable head-sheet gaps in advance for respective types of sheets. Also, the user can select a setting value indicative of a feeding method: "auto feeder" or "ASF (rub preventing)" in a feeding method selection field 1002. The "ASF (rub preventing)" represents a feeding method intended to set a wider head-sheet gap than in normal printing. By setting the "ASF (rub preventing)" as a feeding method via the user interface (FIG. 10) of the printer driver when instructing to perform printing, the user can instruct to perform printing with a wider head-sheet gap than a head-sheet gap corresponding to a setting value selected in the sheet type selection field 1001 in a print job process corresponding to the printing instruction. This makes it possible to prevent a printing sheet as a recording medium from being rubbed.

With the above inkjet recording apparatus which is capable of electrically and mechanically adjusting the head-sheet gap when the user selects a setting value in the sheet type selection field 1001 or the feeding method selection field 1002 on the user interface of the printer driver, a "head-sheet gap designation command" which designates the heads-sheet gap ("wide" or "narrow") for one printing (hereinafter referred to as "one print job"), which is designated by the user through operation of the host computer, can be issued from the host computer at least once to the inkjet recording apparatus, so that the head-sheet gap can be adjusted According to this method, since the head-sheet gap designation command is designated according to a setting, e.g. the type of recording medium, made by the user for the printer driver on the host computer, a specification change due to e.g. the addition of a new recording medium or a change in the material of a recording medium in settings of the printer driver can be coped with only by allotting the head-sheet gap designating command to the recording medium which has been added or changed in material. Therefore, it is relatively easy to cope with such a specification change by version upgrade of the printer driver.

Further, a problem that the recording head and a recording medium rub each other due to e.g. environmental changes although the recording medium is a type that should be printed with a narrow head-sheet gap can be solved by providing a switch or the like which forces the head-sheet gap to be widened ("AFS (rub preventing)" as a feeding method) on the user interface of the printer driver, so that a head-sheet gap designating command which designates a "wide" head-sheet gap is issued once for one print job when the user turns on the switch.

Conventionally, in the case where an image taken by e.g. a digital camera is printed using the inkjet recording apparatus, it has been generally carried out to connect the digital camera and a host computer to each other via an interface such as a USB (Universal Serial Bus) to temporarily load the image taken by the digital camera into the host computer, and then transfer the image from the host computer to the inkjet recording apparatus so that the image can be printed.

In recent years, however, the inkjet recording apparatus has been further improved in terms of functions. For example, in recent years, there has been developed an inkjet recording apparatus which is provided with a second interface other than the interface connected to the host computer, and is connected directly to a digital camera via the second interface to support a camera direct printing function which enables printing without a host computer.

If the above described method in which a head-sheet gap designating command is issued once for one print job is applied to the inkjet recording apparatus which has the camera direct printing function which enables printing without a host computer, it is necessary to issue the head-sheet gap designating command from the digital camera, which raises the problem that items which should be originally set through operation of the inkjet recording apparatus must be set through operation of the digital camera.

Also, according to the camera direct printing function, firmware of the digital camera or the inkjet recording apparatus must be updated so as to cope with a specification change due to e.g. the addition of a new recording medium or a change in the material of a recording medium in settings made through the printer driver as described above, and this is more difficult as compared with update of the printer driver since it is now desired to support the camera direct printing function through operation of digital cameras with different specifications.

SUMMARY OF THE INVENTION

It is an object of the present invention to provide a printing apparatus and a printing control method which can eliminate the necessity of issuing a head-sheet gap setting command from a digital camera even during camera direct printing, and can positively prevent a recording medium from being rubbed by a recording head and becoming tainted, as well as a program for implementing the printing control method.

To attain the above object, in a first aspect of the present invention, there is provided a printing apparatus that prints an image on a recording medium by discharging ink from a recording head to attach the ink to the recording medium, comprising an adjusting device that carries out adjustment of a head-medium gap between the recording head and the recording medium according to a command sent from an information processing apparatus, and a controller that receives a temporary command effective for one printing and a setting command storing a setting status of the printing apparatus from the information processing apparatus, the controller being operable when the head-medium gap is set by the setting command, to cause the adjusting device to carry out the adjustment according to the head-medium gap set by the setting command, and perform printing while ignoring the head-medium gap designated by the temporary command.

According to the first aspect of the present invention, when the head-medium gap is set by the setting command sent from the information processing apparatus, the printing apparatus adjusts the gap between the recording head and the recording medium according to the head-medium gap set by the setting command and performs printing, while ignoring the head-medium gap designated by the temporary command effective for one printing. As a result, the head-medium gap set by the setting command is also effective for a print job input to the printing apparatus via a communication line different from a communication line which connects the printing apparatus and the information processing apparatus to each other, and therefore, even in camera direct printing in which print data is sent from a digital camera to the inkjet recording apparatus via a different communication line without going through the information processing apparatus, there is no necessity of issuing a setting command from the digital camera as in the prior art, and it is possible to positively prevent the recording medium from being rubbed by the recording head and becoming tainted.

Also, a specification change due to the addition of a new recording medium, a change in the material of a recording medium, or the like can be coped with even without updating firmware of the digital camera or the printing apparatus, because the head-medium gap between the recording head and the, recording medium which has been added or changed in material can be set by the setting command sent from the information processing apparatus to the printing apparatus.

Preferably, the controller is operable when the head-medium gap is not set by the setting command or when a setting made by the setting command is canceled, to cause the adjusting device to carry out the adjustment according to the head-medium gap designated by the temporary command, and perform printing.

Further, according to the first aspect of the present invention, when the head-medium gap is not set by the setting command, or when a setting made by the setting command is canceled, the printing apparatus adjusts the gap between the recording head and the recording medium according to the temporary command, and performs printing. As a result, it is possible to positively prevent the recording medium from being rubbed by the recording head and becoming tainted.

Preferably, the setting command includes a command for instructing to perform printing according to the head-medium gap designated by the temporary command.

More preferably, the controller is operable when the head-medium gap is not designated even by the temporary command, to cause the adjusting device to carry out the adjustment according to the head-medium gap set in advance in the printing apparatus, and perform printing.

Further, according to the first aspect of the present invention, when the head-medium gap is not designated even by the temporary command, or when a setting made by the setting command is canceled, and at the same time, the head-medium gap is not set even by the temporary command, the printing apparatus adjusts the gap between the recording head and the recording medium according to the head-medium gap set in advance in the printing apparatus. As a result, it is possible to prevent printing from being performed with the head-medium gap not adjusted, and to positively prevent the recording medium from being rubbed by the recording head and becoming tainted.

To attain the above object, according to a second aspect of the present invention, there is provided a printing apparatus that prints an image on a recording medium by discharging ink from a recording head to attach the ink to the recording medium, comprising first and second communication devices that control communication with apparatuses outside the printing apparatus, an adjusting device that carries out adjustment of a head-medium gap between the recording head and the recording medium according to a command sent from an information processing apparatus via the first communication device, a storage device that stores a setting made by a setting command that is sent from the information processing apparatus and stores a setting status of the printing apparatus, and a controller that is operable when the head-medium gap is set by the setting command, to cause the adjusting device to carry out the adjustment according to the head-medium gap set by the setting command, and perform printing of print data sent via the second communication device.

According to the second aspect of the present invention, when the head-medium gap is set by the setting command sent from the information processing apparatus to the printing apparatus via the first communication device, the printing apparatus adjusts the gap between the recording head and the recording medium according to the head-medium gap set by the setting command, and performs printing of print data sent from a digital camera via the second communication device. As a result, even in camera direct printing, it is possible to positively prevent the recording medium from being rubbed by the recording head and becoming tainted.

Preferably, the controller is operable when the head-medium gap is not set by the setting command or when a setting made by the setting command is canceled, to cause the adjusting device to carry out the adjustment according to the head-medium gap set in advance in the printing apparatus, and perform printing of the print data.

Preferably, the second communication device is connectible to a digital camera.

To attain the above object, according to a third aspect of the present invention, there is provided a printing control method executed by a printing apparatus that prints an image on a recording medium by discharging ink from a recording head to attach the ink to the recording medium, comprising a command receiving step of receiving a temporary command effective for one printing and a setting command storing a setting status of the printing apparatus from an information processing apparatus, and a printing step of adjusting a head-medium gap between the recording head and the recording medium according to the head-medium gap set by the setting command and performing printing while ignoring the head-medium gap designated by the temporary command, when the head-medium gap between the recording head and the recording medium is set by the setting command.

To attain the above object, according to a fourth aspect of the present invention, there is provided a printing control method executed by a printing apparatus that prints an image on a recording medium by discharging ink from a recording head to attach the ink to the recording medium, comprising a storing step of storing in a storage a setting made by a setting command that is sent from an information processing apparatus via a first communication device of the printing apparatus and stores a setting status of the printing apparatus, and a printing step of adjusting a head-medium gap between the recording head and the recording medium according to the head-medium gap set by the setting command, and performing printing of print data sent via a second communication device of the printing apparatus, when the head-medium gap is set by the setting command.

To attain the above object, according to a fifth aspect of the present invention, there is provided a program executed by a printing apparatus that prints an image on a recording medium by discharging ink from a recording head to attach the ink to the recording medium, comprising a command receiving module for receiving a temporary command effective for one printing and a setting command storing a setting status of the printing apparatus, which are sent from an information processing apparatus to the printing apparatus, and a printing module for adjusting a head-medium gap between the recording head and the recording medium according to the head-medium gap set by the setting command while ignoring the head-medium gap designated by the temporary command, and causing the printing apparatus to perform printing, when the head-medium gap between the recording head and the recording medium is set by the setting command.

To attain the above object, according to a sixth aspect of the present invention, there is provided a program executed by a printing apparatus that prints an image on a recording medium by discharging ink from a recording head to attach the ink to the recording medium, comprising a storing module for storing a setting made by a setting command that is sent from an information processing apparatus via a first communication device of the printing apparatus and stores a setting status of the printing apparatus, and a printing module for adjusting a head-medium gap between the recording head and the recording medium according to the head-medium gap set by the setting command, and performing printing of print data sent to the printing apparatus from a digital camera via a second communication device of the printing apparatus, when the head-medium gap is set by the setting command.

The above and other objects, features, and advantages of the invention will become more apparent from the following detailed description taken in conjunction with the accompanying drawings.

BRIEF DESCRIPTION OF THE DRAWINGS

FIG. 7 is a view showing a concrete example of a command for setting the head-sheet gap;

DETAILED DESCRIPTION OF THE PREFERRED EMBODIMENTS

The present invention will now be described in detail with reference to the drawings showing preferred embodiments thereof.

Figure 1:
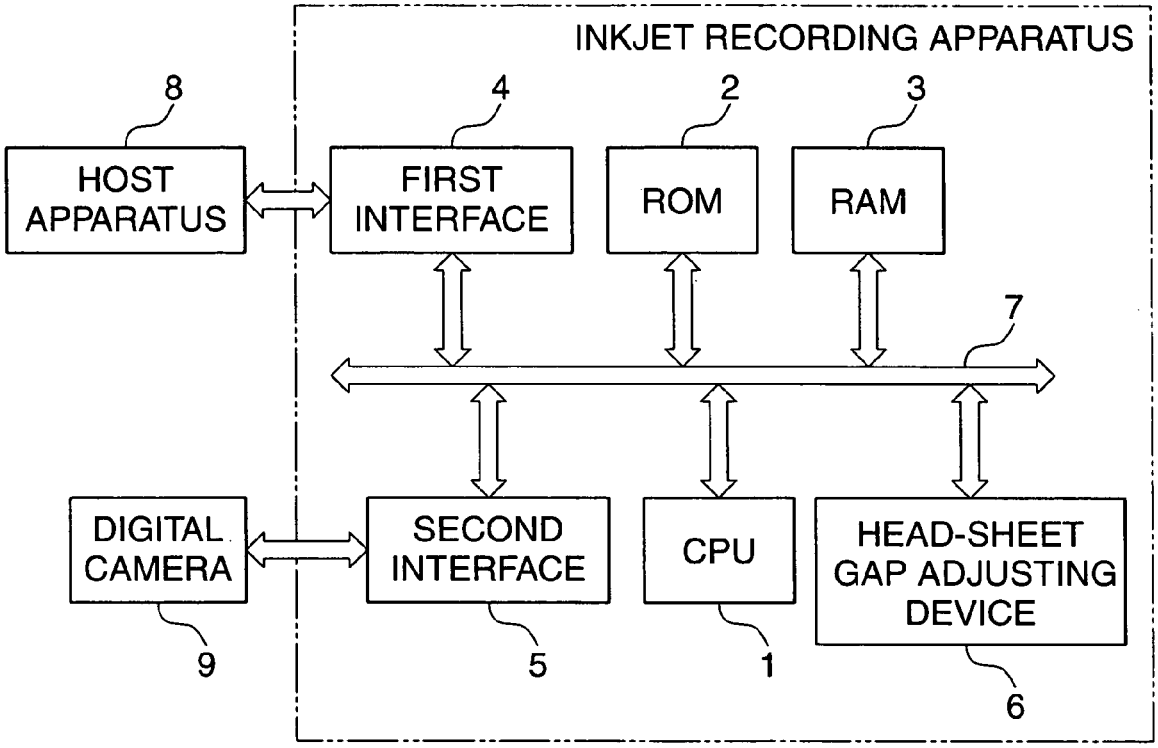
FIG. 1 is a block diagram showing the construction of an inkjet recording apparatus as a printing apparatus according to a first embodiment of the present invention.

FIG. 1 is a block diagram showing the construction of an inkjet recording apparatus as a printing apparatus according to a first embodiment of the present invention.

As shown in FIG. 1, the inkjet recording apparatus (printing apparatus) is adapted to print an image on a recording medium by an inkjet recording method, and is comprised of a CPU (adjusting device and controller) 1, a ROM (storage device) 2, a RAM (storage device) 3, a first interface (first communication device) 4, a second interface (second communication device) 5, a head-sheet gap adjusting device (adjusting device) 6, and a bus 7. The inkjet recording apparatus is connected to a host apparatus (information processing apparatus) 8 and an electronic device 9 for communication therewith. In the present embodiment, it is assumed that the electronic device 9 is implemented by a digital camera.

The CPU 1 is a central processing unit which controls the overall operation of the inkjet recording apparatus, and carries out processes shown in flow charts of FIGS. 2 and 3, described later (first embodiment), and a process shown in a flow chart of FIG. 4, described later (second embodiment) in accordance with programs stored in the ROM 2. The ROM 2 is a memory which stores various programs including a head-sheet gap setting command reception analyzing program, a print job analyzing program executed in response to a printing request form the host apparatus 8, and a print job analyzing program executed in response to a printing request from the digital camera 9, which are intended to carry out respectively the processes shown in the flow charts of FIGS. 2 to 4 under the control of the CPU 1, and "values designated as default". The RAM 3 is a memory which is used as a working area for execution of various programs, and is comprised of areas for storing print settings (including the head-sheet gap) which are effective for one print job, and print settings (including the head-sheet gap) which are continuously effective for a plurality of print jobs until power supply is turned off.

The first interface 4 provides interface for transmission and reception of commands and data to and from the host apparatus 8. The second interface 5 provides interface for transmission and reception of commands and data to and from the digital camera 9. The head-sheet gap adjusting device 6 is comprised of a motor, a driving means (motor driver) for driving the motor, and so forth, and adjusts the head-sheet gap (the value which defines the gap between a recording head which discharges ink and a recording sheet) under the control of the CPU 1. The bus 7 is a transmission path via which data, addresses, and control signals are sent, and to which the above component parts are connected. It should be noted that the inkjet recording apparatus is provided with a printing mechanism including the recording head, a recording medium conveying mechanism, and so forth in addition to the above component parts, but they are not illustrated in the drawings.

The host apparatus 8 is implemented by e.g. a computer which is capable of communicating with the inkjet recording apparatus via the first interface 4, and has a function of sending a temporary command (head-sheet gap designating job command) effective only for one printing to be performed by the inkjet recording apparatus to the same, and a function of sending a setting command (head-sheet gap setting command) which, if set once, stores a print setting status until the next setting command or a cancellation command is sent to the inkjet recording apparatus, or until power supply of the inkjet recording apparatus is turned off, to the inkjet printing apparatus. Here, the head-sheet gap setting command includes a command for instructing to perform printing according to the head-sheet gap designated by the head-sheet designating job command. The digital camera 9 is connected to the inkjet recording apparatus via the second interface 5 for communication therewith.

Figure 8:
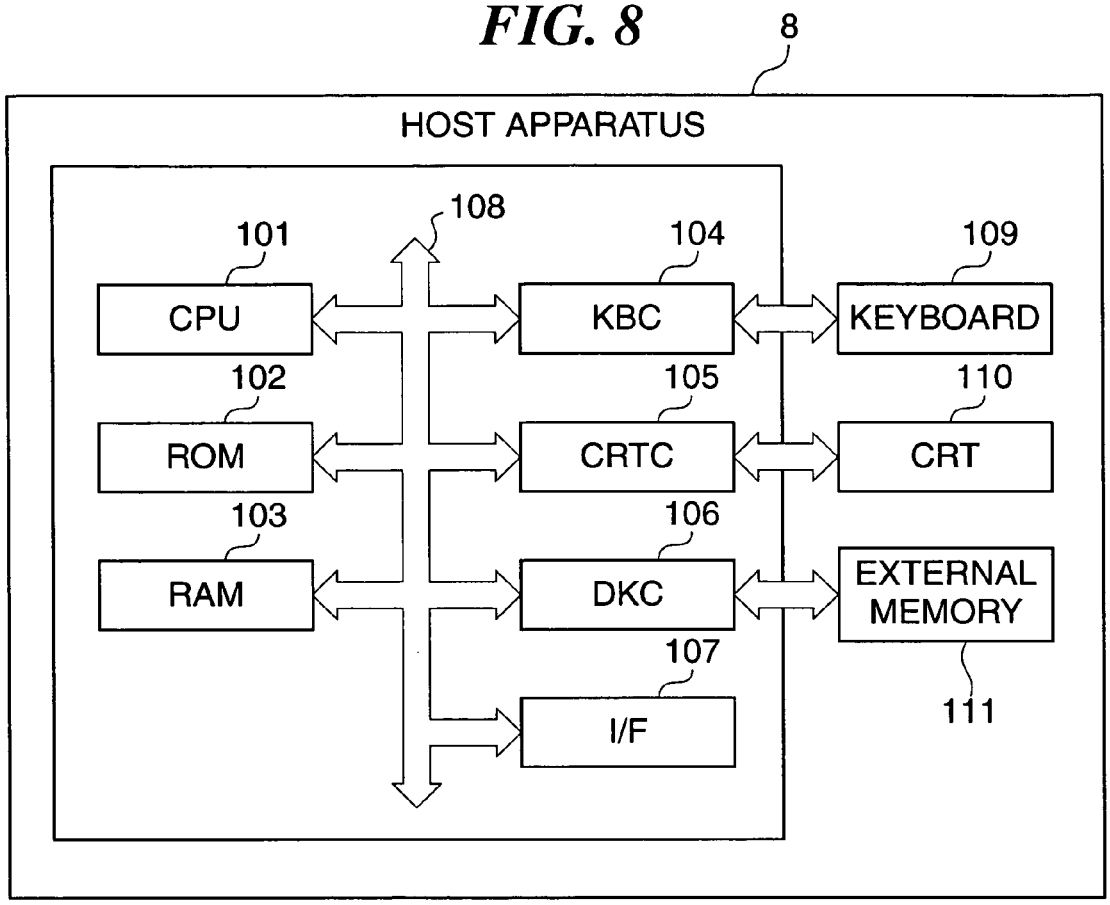
FIG. 8 is a block diagram showing the construction of the host apparatus in FIG. 1.

FIG. 8 is a block diagram showing the construction of the host apparatus appearing in FIG. 1.

As shown in FIG. 8, the host apparatus (host computer) 8 includes a CPU (controller) 101. The CPU 101 carries out processing of documents, in which drawings, images, characters, tables (including table calculations), and so forth are included, according to a document processing program or a like program stored in a ROM 102 or an external memory 111, and collectively controls component parts (devices) connected to a system bus 108. The ROM 102 or the external memory 111 stores an operating system program (hereinafter referred to as "OS") as a control program on which the CPU 101 operates, and stores font data for use in carrying out the document processing, and various kinds of data for use in carrying out the document processing.

A RAM 103 functions as a main memory, a working area, and so forth for the CPU 101. A keyboard controller (KBC) 104 controls a keyboard 109 and the input of keys from a pointing device, not shown. A CRT controller (CRTC: display controller) 105 controls display on a CRT display (CRT: display section) 110. A disk controller (DKC) 106 controls access to the external memory 111 which stores a boot program, various applications, font data, user files, editing files, a printer control command generating program (hereinafter refereed to as "the printer driver"), and so forth. The external memory 111 is implemented by a hard disk (HD), a floppy disk (FD), or the like.

An interface (I/F) 107 is connected to the inkjet recording apparatus (printing apparatus) according to the present embodiment, for controlling communication therebetween. It should be noted that, for example, the CPU 101 expands (rasterizes) display information set on the RAM 103 into outline fonts to enable WYSIWYG (What You See Is What You Get) on the CRT 110. Also, the CPU 101 opens various registered windows according to commands designated by a mouse cursor displayed on the CRT 110 or the like to carry out various kinds of data processing. As a result, when performing printing, the user can open windows relating to print settings so as to make settings as to printing to be performed by the inkjet recording apparatus, settings as to a printing method to be executed by the printer driver, such as selection of a print mode.

Figure 9:
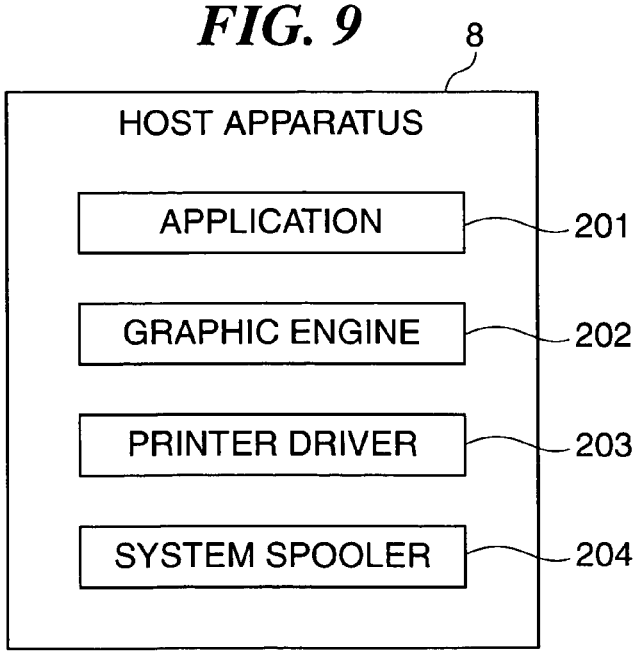
FIG. 9 is a view useful in explaining the configuration of software modules carried out by the host apparatus in FIG. 8.

FIG. 9 is a view useful in explaining the configuration of software modules carried out by the host apparatus in FIG. 8. As shown in FIG. 9, an application 201, a graphic engine 202, a printer driver 203, and a system spooler 204 are program modules which exist as files stored in the ROM 102 or the external memory 111, and are loaded into the RAM 103 and executed by the operating system (OS) and other modules.

The application 201 and the printer driver 203 can be added to the external memory 111 (HD) via an FD, a CD-ROM, or a network, not shown.

The application 201 stored in the external memory 111 is loaded into the RAM 103 and executed; to cause the inkjet recording apparatus to perform printing through the application 201, the graphic engine 202, which is loaded into the RAM 103 so that it can be executed, is used to perform output (drawing).

The graphic engine 202 loads the printer driver 203, which is prepared for each printer, from the external memory 111 into the RAM 103, and causes the printer driver 203 to convert an output from the application 201 into a control command, which can be controlled by the inkjet recording apparatus, to generate a print job. The printer control command thus obtained is output to the inkjet recording apparatus via the interface 107 through the system spooler 204 loaded into the RAM 103 by the OS.

A description will now be given of operations and a flow of control carried out by the host apparatus 8. First, to set a head-sheet gap effective for one print job, the user selects a desired type of recording sheet in the sheet type selection field 1001 on the print setting screen of the printer driver 203 appearing in FIG. 10. As shown in FIG. 11, there are various types of recording sheets. According to the selected type of recording sheet, a head-sheet gap corresponding to the type of recording sheet is obtained by referring to a corresponding table (head-sheet gaps are defined for respective types of recording sheets) stored in advance in the printer driver to generate a print job in which the value of the obtained head-sheet gap is embedded as a control command (hereinafter referred to as "the head-sheet gap designating job command"). When the inkjet recording apparatus receives the print job thus generated, the head-sheet gap embedded as the control command in the print job is applied to the print job.

In the case of direct printing in which data input from the digital camera 9 via the second interface 5 of the inkjet recording apparatus is printed, a head-sheet gap which is currently set in the inkjet recording apparatus is applied as a head-sheet gap for the direct printing as described above.

In the conventional inkjet recording apparatus, the user can adjust the head-sheet gap using a manual lever or the like for each printing, but in recent inkjet recording apparatuses which are not provided with manual levers or the like so as to reduce costs, the user cannot manually adjust the head-sheet gap.

To address this problem, according to the present invention, the host apparatus 8 connected to the inkjet recording apparatus via the first interface 4 sends a head-sheet gap setting command for continuously applying a currently set head-sheet gap to a plurality of print jobs to the inkjet recording apparatus until power supply of the inkjet recording apparatus is turned off, or until a new head-sheet gap setting command is received.

Figure 5:
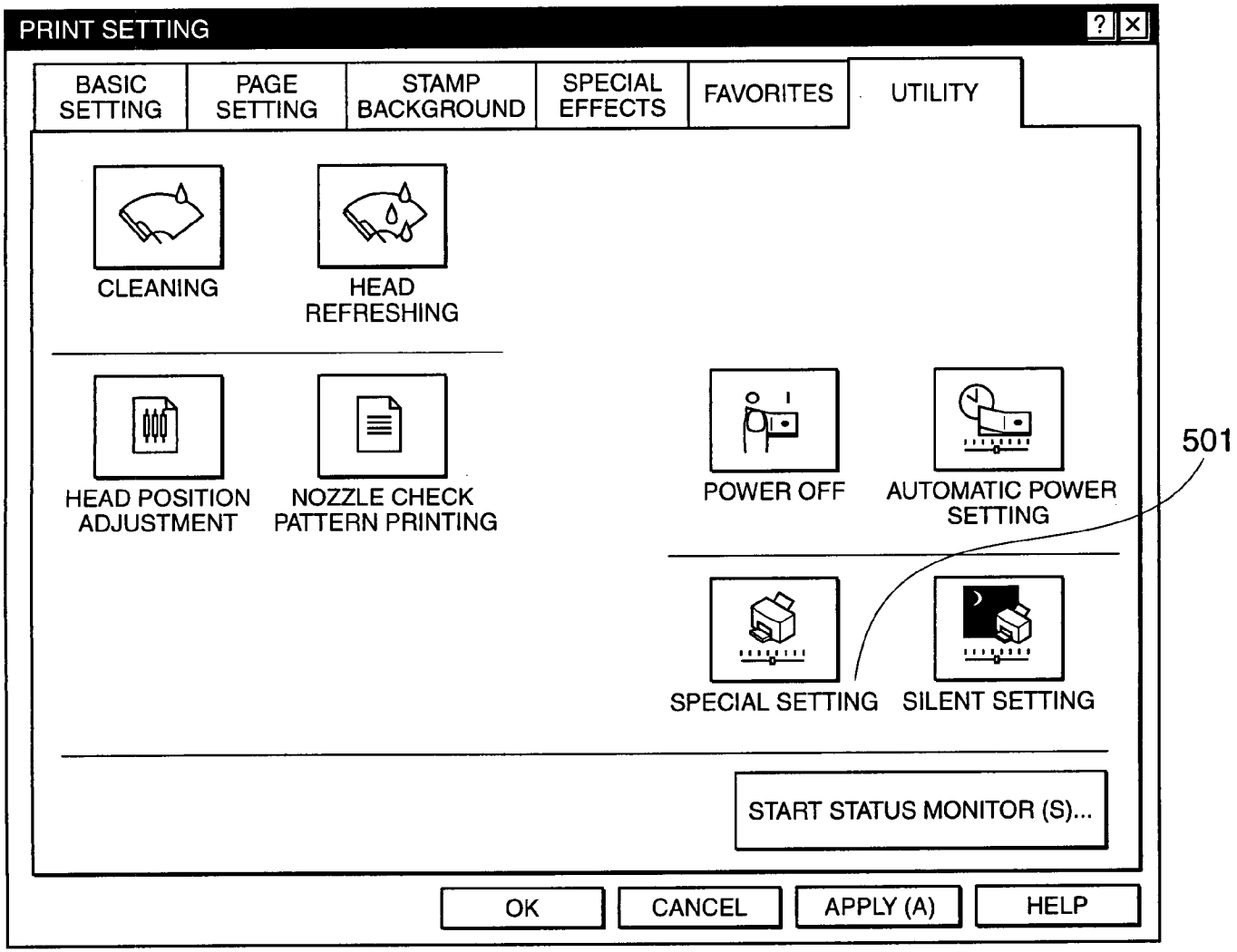
FIG. 5 is a view showing a print setting screen of a printer driver as a utility screen.
Figure 10:
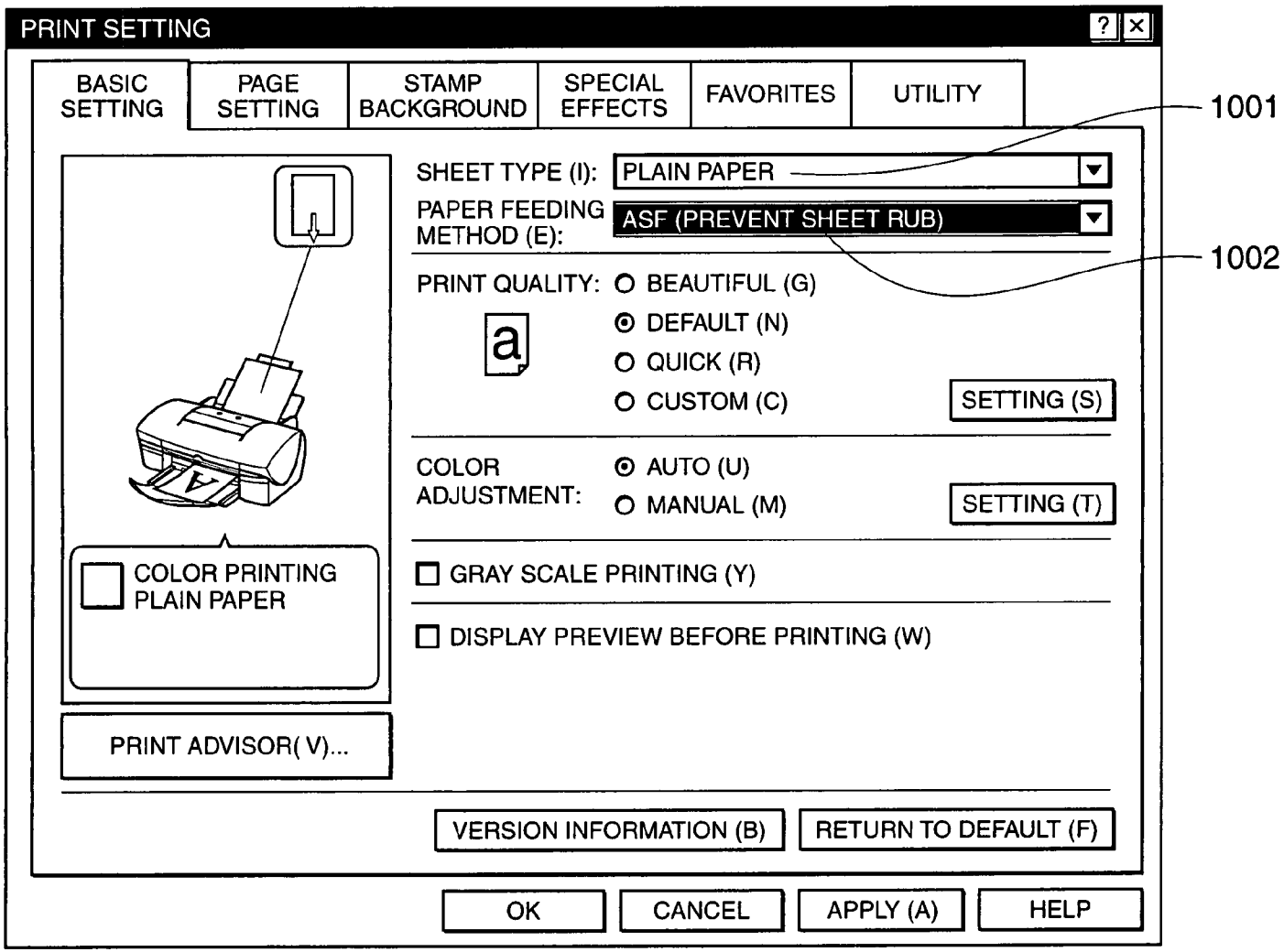
FIG. 10 is a view showing a user interface on a print setting screen of a conventional printer driver.
Figure 11:
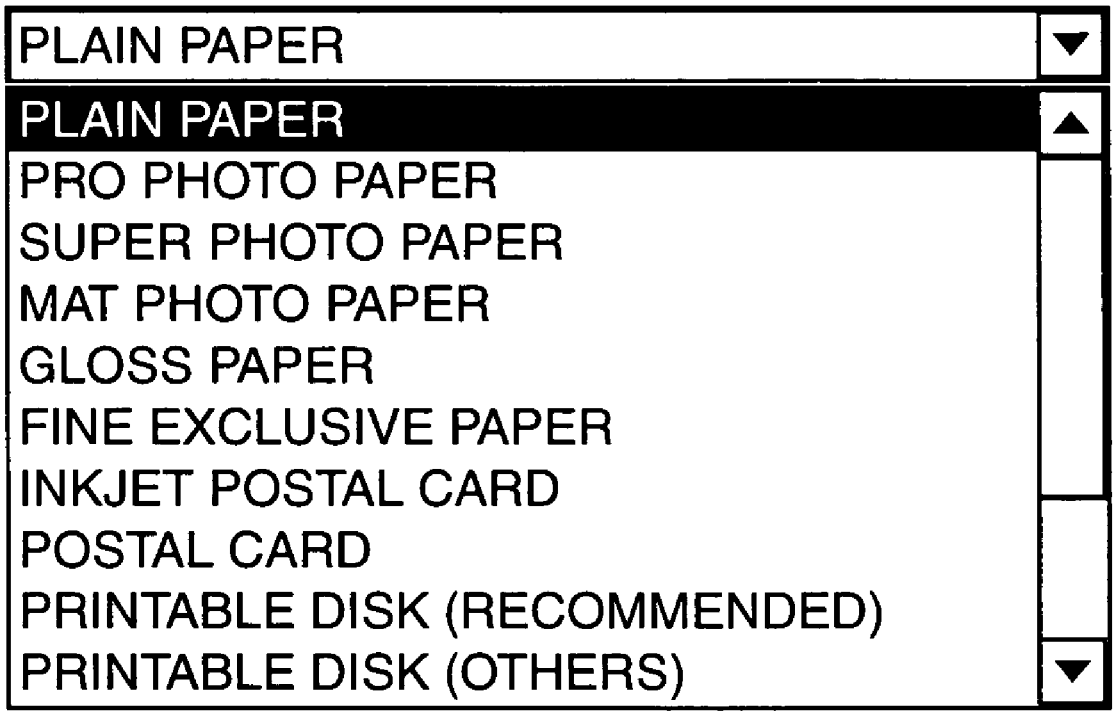
FIG. 11 is a view showing a menu for selecting the type of sheet as a recording medium.

First, a print setting screen in FIG. 5 as a utility screen is displayed by depressing a "utility" tab on the print setting screen of the printer driver in FIG. 10. Various setting commands for the inkjet recording apparatus can be sent from the utility screen in FIG. 5. Here, when the user depresses a "special setting" button 501, a special setting dialog screen in FIG. 6 is displayed.

Figure 6:
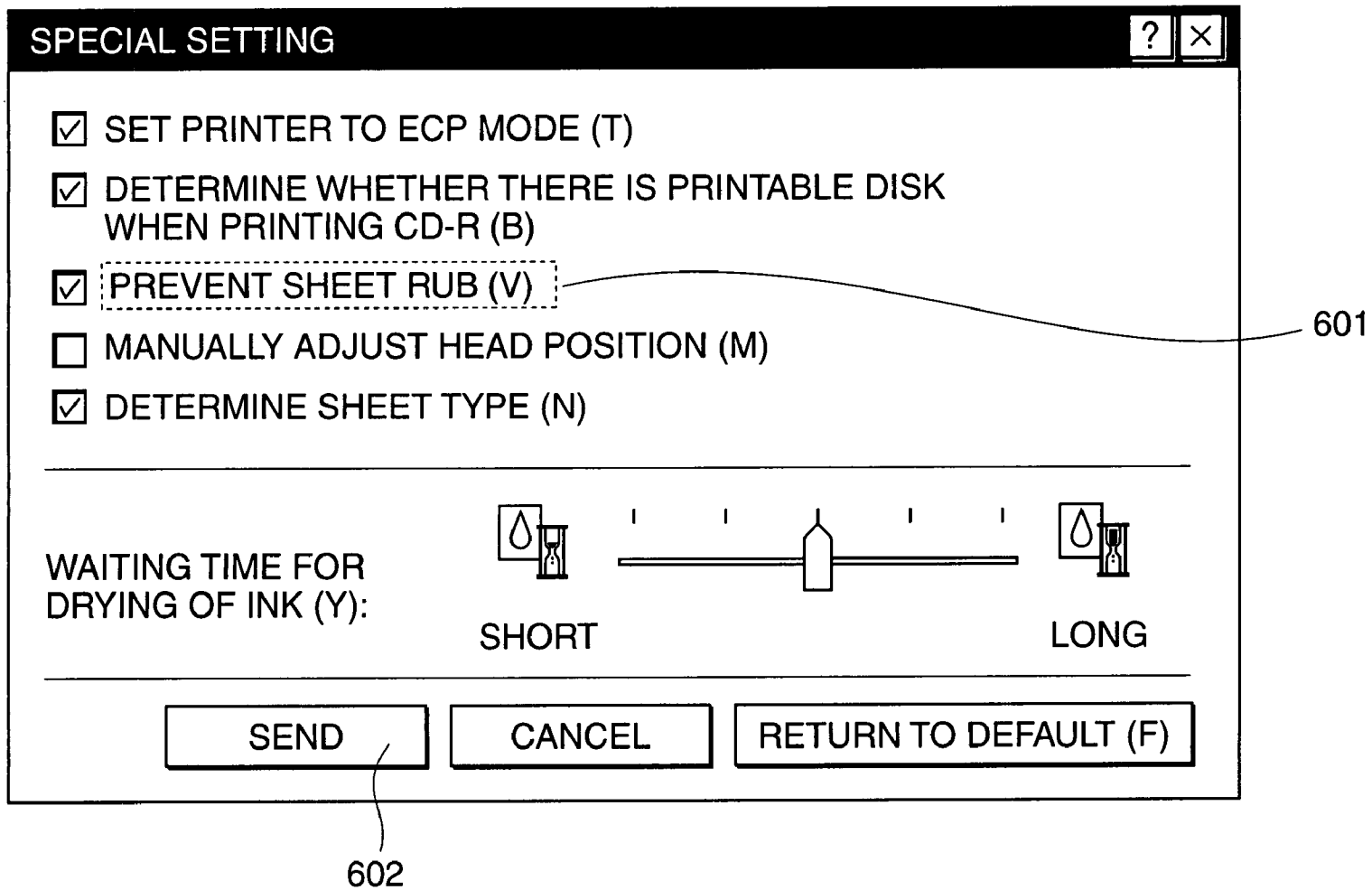
FIG. 6 is a view showing a special setting dialog screen of the printer driver.

When a "prevent sheet rub" check box 601 is checked on and then a send button 602 is depressed on the special setting dialogue screen in FIG. 6, a setting command relating to the checked-on item is sent to the inkjet recording apparatus. When the send button 602 is depressed with the "prevent sheet rub" check box 601 checked on, a head-sheet gap setting command is sent to the inkjet recording apparatus so as to widen the head-sheet gap. The head-sheet gap setting command sent on this occasion is different from the head-sheet gap designating job embedded in the print job, and is sent as such a command as shown in FIG. 7.

The CPU 1 of the inkjet recording apparatus provides control as described below by executing the head-sheet gap setting command reception analyzing program, the print job analyzing program in response to a printing request from the host apparatus 8, and the print job analyzing program in response to a printing request from the digital camera 9. It should be noted that the details of the control will be described with reference to the flow charts of FIGS. 2 to 4.

When the head-sheet gap is set according to the head-sheet gap setting command in FIG. 7, the head-sheet gap is adjusted according to the head-sheet gap (Wide) set by the head-sheet gap setting command while the head-sheet gap (Auto) designated by the heads-sheet gap designating job command is ignored, and then printing is performed.

When the head-sheet gap is not set by the head-sheet gap setting command, or when a setting which is specified by the head-sheet gap setting command is canceled, the head-sheet gap is adjusted according to the heads-sheet gap (Auto) designated by the head-sheet gap designating job command, and then printing is performed.

When the head-sheet gap is set by the head-sheet gap setting command, the head-sheet gap is adjusted according to the head-sheet gap (Wide) set by the heads-sheet gap setting command, and then printing of print data sent from the digital camera 9 via the second interface 5 is performed.

When the head-sheet gap is not set by the head-sheet gap setting command, or when a setting which is specified by the head-sheet gap setting command is canceled, and at the same time, the-head-sheet gap is not designated even by the head-sheet gap designating job command, the head-sheet gap is adjusted according to a value designated as default, which is stored in advance in the inkjet recording apparatus, and then printing is performed.

Referring next to the flow charts of FIGS. 2 and 3, a description will be given of the operation of the inkjet recording apparatus according to the present embodiment.

Figure 2:
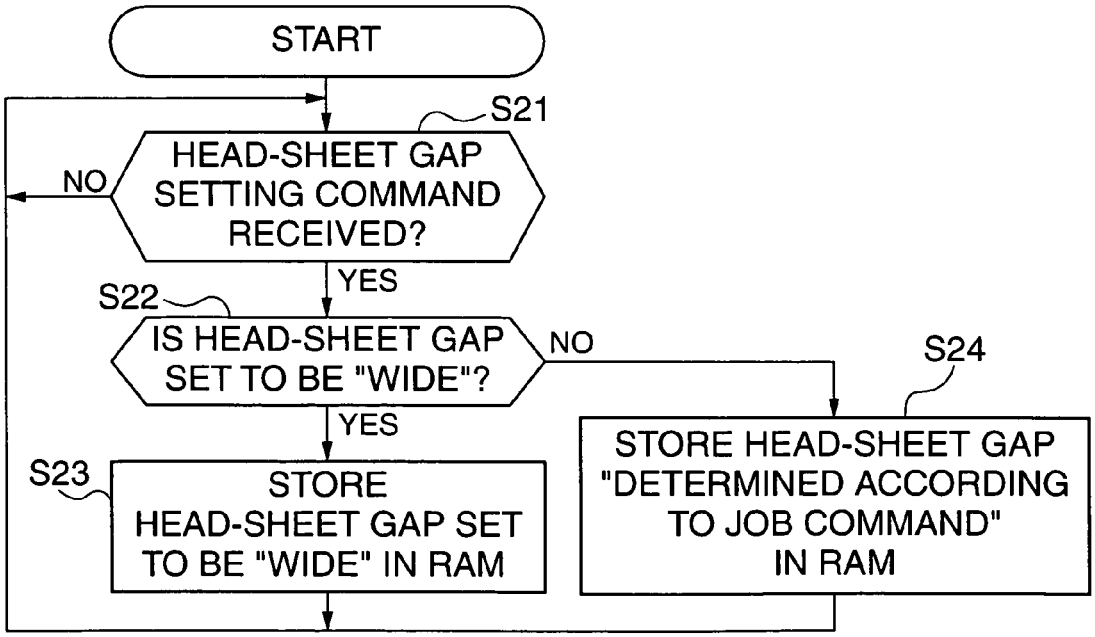
FIG. 2 is a flow chart showing a process which is carried out by the inkjet recording apparatus in FIG. 1 in accordance with a head-sheet gap setting command reception analyzing program.

The flow chart of FIG. 2 shows a process carried out by the inkjet recording apparatus in accordance with the head-sheet gap setting command reception analyzing program.

When the CPU 1 of the inkjet recording apparatus starts executing the head-sheet gap setting command reception analyzing program, as shown in FIG. 2, it is determined whether or not a head-sheet gap setting command (FIG. 7) sent from the host apparatus 8 via the first interface 4 of the inkjet recording apparatus has been received (step S21), and if the head-sheet gap setting command has been received, it is determined whether or not the head-sheet gap designated by the head-sheet gap setting command is set to be "Wide" (step S22).

If it is determined that the head-sheet gap is set to be "Wide", information indicative of "Wide" as a head-sheet gap setting is stored in a continuous setting area, not shown, of the RAM 3 (step S23). On the other hand, if it is determined that the head-sheet gap is not set to be "Wide", information indicative of such a setting that "the head-sheet gap is to be set according to a value designated by a head-sheet gap designating job command" as a head-sheet gap setting is stored in the RAM 3 (step S24).

Figure 3:
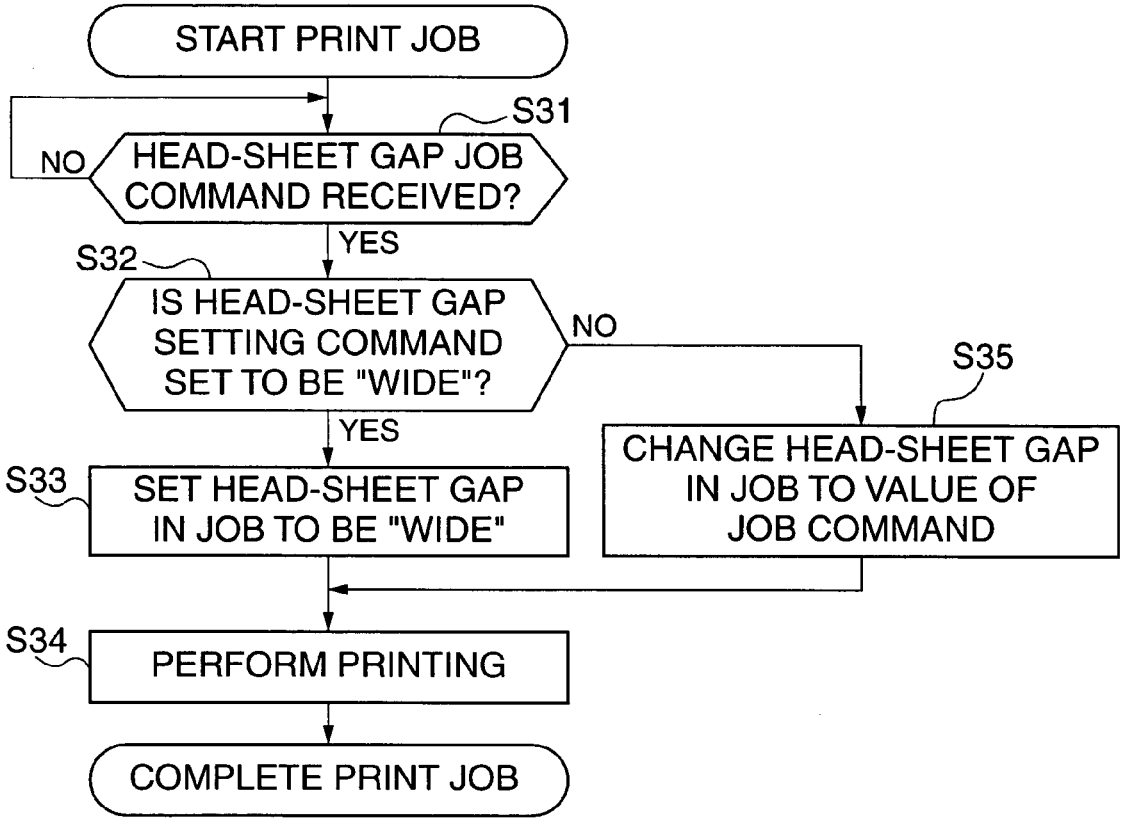
FIG. 3 is a flow chart showing a process which is carried out by the inkjet recording apparatus in FIG. 1 in accordance with a print job analyzing program in response to a printing request from a host apparatus.

The flow chart of FIG. 3 shows a process carried out by the inkjet recording apparatus in accordance with the print job analyzing program in response to a printing request from the host apparatus 8.

When the CPU 1 of the inkjet recording apparatus starts executing the print job analyzing program, as shown in FIG. 3, it is determined whether or not a head-sheet gap designating job command, i.e. a print job sent from the host apparatus 8 via the first interface 4 of the inkjet recording apparatus has been received (step S31), and if the head-sheet gap designating job command has been received, whether or not the head-sheet gap has already been set to be "Wide" by the above described head sheet gap setting command reception analyzing program in FIG. 2 is determined by referring to the continuous setting area of the RAM 3 (step S32).

If it is determined that the head-sheet gap is set to be "Wide", the head-sheet gap adjusting device 6 is caused to adjust the head-sheet gap to a wide setting by prioritizing the fact that the head-sheet gap is set to be "Wide" in the print job (step S33), and then the inkjet recording apparatus is caused to perform printing of print data sent from the host apparatus 8 via the first interface 4 (step S34), to complete the print job.

On the other hand, if it is determined that the head-sheet gap is not set to be "Wide", this means that the information indicative of "the head-sheet gap is to be set according to a value designated by the head-sheet gap designating job command" is stored in the RAM 3, and hence the head-sheet gap adjusting device 6 is caused to adjust the head-sheet gap according to the value of the head-sheet gap designated by the head-sheet designating job command received from the host apparatus 8 in the step S31 (step S35), and the inkjet recording apparatus is caused to perform printing of print data sent from the host apparatus 8 via the first interface 4 (step S34), to complete the print job.

It should be noted that in the case where there is no head-sheet gap designating job command in one print job, the head-sheet gap may be adjusted using a "value designated as default" stored in the ROM 2. Also, it should be noted that a value set by the head-sheet gap setting command is continuously effective until a new head-sheet gap setting command is received, or until power supply of the inkjet recording apparatus is turned off.

As described above, according to the present embodiment, the inkjet recording apparatus capable of electrically and mechanically adjusting the head-sheet gap receives a head-sheet gap designating job command (temporary command) which is sent from the host apparatus 8 via the first interface 4 and which is effective only for one printing, and a head-sheet gap setting command which stores a setting status obtained in advance if set once, until the next setting command or a cancellation command is sent, and if the head-sheet gap is set by the head-sheet gap setting command, the inkjet recording apparatus adjusts the head-sheet gap according to the head-sheet gap set by the head-sheet gap setting command while ignoring the head-sheet gap designated by the head-sheet gap designating job command, and then performs printing. As a result, the following effects can be obtained.

The head-sheet gap set by a head-sheet gap setting command sent from the host apparatus 8 to the inkjet recording apparatus via the first interface 4 is also effective for a print job which is input via the interface (the second interface 5) different from the first interface 5, and therefore, even in camera direct printing in which print data is sent to the inkjet recording apparatus from the digital camera 9 via the second interface 4 without going through the host apparatus 8 to print the print data, there is no necessity of issuing a head-sheet gap setting command from a digital camera as in the prior art, and it is possible to positively prevent a recording medium from being rubbed by the recording head and becoming tainted.

Further, a specification change due to the addition of a new recording medium, a change in the material of a recording medium, or the like can be coped with even without updating firmware of the digital camera 9 or the inkjet recording apparatus, because the head-sheet gap between the recording head and the recording medium which has been added or changed in material can be set by a head-sheet gap setting command sent from the host apparatus 8 to the inkjet recording apparatus.

A description will now be given of a second embodiment of the present invention. An inkjet recording apparatus as a printing apparatus according to the second embodiment is identical in construction with the inkjet recording apparatus according to the first embodiment (refer to FIG. 1) described above in detail, and therefore detailed description thereof is omitted.

Referring to the flow chart of FIG. 4, a description will now be given of the operation of the inkjet recording apparatus according to the present embodiment.

Figure 4:
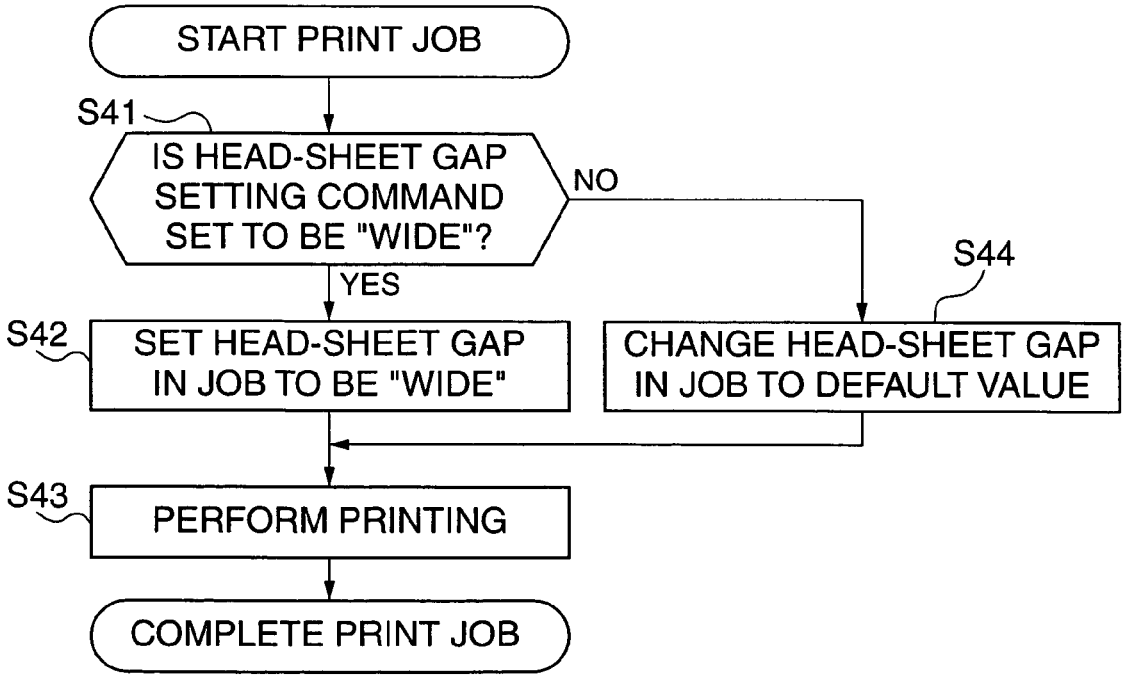
FIG. 4 is a flow chart showing a process which is carried out by an inkjet recording apparatus as a printing apparatus according to a second embodiment of the present invention in accordance with a print job analyzing program in response to a printing request from a digital camera.

The flow chart of FIG. 4 shows a process carried out by the inkjet recording apparatus in accordance with the print job analyzing program in response to a printing request from the digital camera 9.

When the CPU 1 of the inkjet recording apparatus starts executing the print job analyzing program, as shown in FIG. 4, since a head-sheet gap designating job command is not sent from the digital camera 9 via the second interface 5 of the inkjet recording apparatus (in other words, the digital camera 9 does not have a function of sending a command corresponding to the type of the printing apparatus), it is determined whether or not the head-sheet gap has been set to be "Wide" by the above described head sheet gap setting command reception analyzing program in FIG. 2 (step S41).

If it is determined that the head-sheet gap is set to be "Wide", the head-sheet gap adjusting device 6 is caused to adjust the head-sheet gap to a wide setting since the head-sheet gap is set to be "Wide" in a print job (step S42), and then the inkjet recording apparatus is caused to perform printing of print data sent from the digital camera 9 via the second interface 5 (step S43), to complete the print job.

On the other hand, if it is determined that the head-sheet gap is not set to be "Wide", the head-sheet gap adjusting device 6 is caused to adjust the head-sheet gap according to a "value designated as default" stored in advance in the ROM 2 of the inkjet recording apparatus (step S44), and the inkjet recording apparatus is caused to perform printing of print data sent from the digital camera 9 via the second interface 5 (step S43), to complete the print job.

As described above, according to the present embodiment, the inkjet recording apparatus capable of electrically and mechanically adjusting the head-sheet gap, when the head-sheet gap is set by a head-sheet gap setting command sent from the host apparatus 8 via the first interface 4, adjusts the head-sheet gap according to the head-sheet gap set by the head-sheet gap setting command, and performs printing of print data sent from the digital camera 9 via the second interface 5, and on the other hand, when the head-sheet gap is not set by the head-sheet gap setting command (or when a setting made by the head-sheet gap setting command is canceled), the inkjet recording apparatus adjusts the head-sheet gap according to a default value stored in advance in the inkjet recording apparatus, and performs the printing as above. As a result, the following effects can be obtained.

The head-sheet gap set by a head-sheet gap setting command sent from the host apparatus 8 to the inkjet recording apparatus via the first interface 4 is also effective for a print job which is input via the interface (the second interface 5) different from the first interface 4, and therefore, even in camera direct printing in which print data is sent to the inkjet recording apparatus from the digital camera 9 via the second interface 5 without going through the host apparatus 8 to print the print data, there is no necessity of issuing a head-sheet gap setting command from a digital camera as in the prior art, and it is possible to positively prevent a recording medium from being rubbed by the recording head and becoming tainted.

Further, a specification change due to the addition of a new recording medium, a change in the material of a recording medium, or the like can be coped with even without updating firmware of the digital camera 9 or the inkjet recording apparatus, because the head-sheet gap between the recording head and the recording medium which has been added or changed in material can be set by a head-sheet gap setting command sent from the host apparatus 8 to the inkjet recording apparatus.

Further, when the head-sheet gap is not set by a head-sheet gap setting command, or when a setting made by a head-sheet gap setting command is canceled, the head-sheet gap is adjusted according to a default value stored in the inkjet recording apparatus, and this solves the problem that printing is performed with the head-sheet gap not adjusted, and therefore it is possible to positively prevent the recording medium from being rubbed by the recording head and becoming tainted.

It is to be understood that the object of the present invention may be accomplished by supplying a computer or a CPU with a program code of software (the flow charts of FIGS. 2 to 4), which realizes the functions of either of the above described embodiments, and causing the computer or the CPU to read out and execute the supplied program code.

In this case, the program code is directly supplied from a storage medium in which the program code is stored, or is supplied by downloading from another computer, a database, or the like, not shown, connected to the Internet, a commercial network, a local area network, or the like.

The form of the program code may be an object code, a program code executed by an interpreter, or script data supplied to an OS (Operating System).

Further, it is to be understood that the object of the present invention may be accomplished by supplying a computer or a CPU with a storage medium storing a program code of software, which realizes the functions of either of the above described embodiments, and causing the computer or the CPU to read out and execute the program code.

In this case, the program code itself read from the storage medium realizes the functions of either of the above described embodiments, and the program code and the storage medium in which the program code is stored constitute the present invention.

Examples of the storage medium for supplying the program code include ROM, a RAM, an NV-RAM, a floppy (registered trademark) disk, a hard disk, an optical disk (registered trademark), a magnetic-optical disk, a CD-ROM, an MO, a CD-R, a CD-RW, a DVD-ROM, a DVD-RAM, a DVD-RW, a DVD+RW, a magnetic tape, and a nonvolatile memory card.

Further, it is to be understood that the functions of either of the above described embodiments may be accomplished not only by executing the program code read out from a computer, but also causing an OS or the like operating on the computer to perform a part or all of the actual operations based on instructions of the program code.

As many apparently widely different embodiments of the present invention can be made without departing from the spirit and scope thereof, it is to be understood that the invention is not limited to the above specific embodiments thereof.

What is claimed is:

1. A printing apparatus that prints an image on a recording medium by discharging ink from a recording head to attach the ink to the recording medium, comprising:

an adjusting device that carries out adjustment of a head-medium gap between the recording head and the recording medium according to a command sent from an information processing apparatus; and a controller that receives, a temporary command effective for one printing and a setting command storing a setting status of the printing apparatus from the information processing apparatus, said controller being operable when the head-medium gap is set by the setting command, to cause said adjusting device to carry out the adjustment according to the head-medium gap set by the setting command, and perform printing while ignoring the head-medium gap designated by the temporary command.

2. A printing apparatus according to claim 1, wherein said controller is operable when the head-medium gap is not set by the setting command or when a setting made by the setting command is canceled, to cause said adjusting device to carry out the adjustment according to the head-medium gap designated by the temporary command, and perform printing.

3. A printing apparatus according to claim 1, wherein the setting command includes a command for instructing to perform printing according to the head-medium gap designated by the temporary command.

4. A printing apparatus according to claim 2, wherein said controller is operable when the head-medium gap is not designated even by the temporary command, to cause said adjusting device to carry out the adjustment according to the head-medium gap set in advance in the printing apparatus, and perform printing.

5. A printing apparatus that prints an image on a recording medium by discharging ink from a recording head to attach the ink to the recording medium, comprising:

first and second communication devices that control communication with apparatuses outside the printing apparatus;

an adjusting device that carries out adjustment of a head-medium gap between the recording head and the recording medium according to a command sent from an information processing apparatus via said first communication device;

a storage device that stores a setting made by a setting command that is sent from the information processing apparatus and stores a setting status of the printing apparatus; and a controller that is operable when the head-medium gap is set by the setting command, to cause said adjusting device to carry out the adjustment according to the head-medium gap set by the setting command, and perform printing of print data sent via said second communication device.

6. A printing apparatus according to claim 5, wherein said controller is operable when the head-medium gap is not set by the setting command or when a setting made by the setting command is canceled, to cause said adjusting device to carry out the adjustment according to the head-medium gap set in advance in the printing apparatus, and perform printing of the print data.

7. A printing apparatus according to claim 5, wherein said second communication device is connectible to a digital camera.

8. A printing control method executed by a printing apparatus that prints an image on a recording medium by discharging ink from a recording head to attach the ink to the recording medium, comprising:

a command receiving step of receiving a temporary command effective for one printing and a setting command storing a setting status of the printing apparatus from an information processing apparatus; and a printing step of adjusting a head-medium gap between the recording head and the recording medium according to the head-medium gap set by the setting command and performing printing while ignoring the head-medium gap designated by the temporary command, when the head-medium gap between the recording head and the recording medium is set by the setting command.

9. A printing control method executed by a printing apparatus that prints an image on a recording medium by discharging ink from a recording head to attach the ink to the recording medium, comprising:

a storing step of storing in a storage a setting made by a setting command that is sent from an information processing apparatus via a first communication device of the printing apparatus and stores a setting status of the printing apparatus; and a printing step of adjusting a head-medium gap between the recording head and the recording medium according to the head-medium gap set by the setting command, and performing printing of print data sent via a second communication device of the printing apparatus, when the head-medium gap is set by the setting command.

10. A program executed by a printing apparatus that prints an image on a recording medium by discharging ink from a recording head to attach the ink to the recording medium, comprising:

a command receiving module for receiving a temporary command effective for one printing and a setting command storing a setting status of the printing apparatus, which are sent from an information processing apparatus to the printing apparatus; and a printing module for adjusting a head-medium gap between the recording head and the recording medium according to the head-medium gap set by the setting command while ignoring the head-medium gap designated by the temporary command, and causing the printing apparatus to perform printing, when the head-medium gap between the recording head and the recording medium is set by the setting command.

11. A program executed by a printing apparatus that prints an image on a recording medium by discharging ink from a recording head to attach the ink to the recording medium, comprising:

a storing module for storing a setting made by a setting command that is sent from an information processing apparatus via a first communication device of the printing apparatus and stores a setting status of the printing apparatus; and a printing module for adjusting a head-medium gap between the recording head and the recording medium according to the head-medium gap set by the setting command, and performing printing of print data sent to the printing apparatus from a digital camera via a second communication device of the printing apparatus, when the head-medium gap is set by the setting command.

* * * * *